United States Patent [19]

Boggs et al.

[11] Patent Number: 4,534,488

[45] Date of Patent: Aug. 13, 1985

[54] LOCKING DEVICE FOR GARBAGE CAN LID

[76] Inventors: John A. Boggs, 270 Tampa Dr., Apt. N-2, Nashville, Tenn. 37211; Robert J. Baltz, 208 Foxwood La., Nashville, Tenn. 37210

[21] Appl. No.: 673,592

[22] Filed: Nov. 21, 1984

[51] Int. Cl.[3] ..... B65D 45/28

[52] U.S. Cl. ..... 220/323; 220/1 T; 220/318

[58] Field of Search ..... 220/323, 1 T, 325, 326, 220/318

[56] References Cited

U.S. PATENT DOCUMENTS

| | | | |
|---|---|---|---|
| 965,590 | 7/1910 | Lokody | 292/70 X |
| 1,015,907 | 1/1912 | Ryder | 220/246 |
| 1,129,222 | 2/1915 | Nylund | 220/323 X |
| 1,160,010 | 11/1915 | Svenson | 220/246 |
| 1,484,062 | 2/1924 | Conner | 220/318 |
| 1,766,366 | 6/1930 | Welch et al. | 220/318 X |
| 2,632,580 | 3/1953 | Biddlecombe | 220/318 |
| 2,717,167 | 9/1955 | Worth | 220/318 X |
| 2,735,571 | 2/1956 | Lockwood | 220/246 |
| 2,735,752 | 2/1956 | Getz | 423/407 |
| 2,768,851 | 10/1956 | Gifford | 220/318 X |
| 3,336,065 | 8/1967 | Roberson | 220/318 X |
| 4,384,656 | 5/1983 | McQuiston et al. | 220/1 T X |
| 4,390,110 | 6/1983 | Pirro | 220/318 |
| 4,489,851 | 12/1984 | Russ | 220/323 |

*Primary Examiner*—Steven M. Pollard
*Attorney, Agent, or Firm*—Harrington A. Lackey

[57] ABSTRACT

A locking device for a container lid closing the open top of a cylindrical container having a radially inwardly opening annular recess. The locking device includes a central hand-controlled vertically reciprocable operating rod connected to the lid, with radially projecting connecting rods connecting the reciprocable operating rod with corresponding elastic latch members normally seated in the annular recess in the locking position. The raising of the operating rod and connecting rods by the handle control mechanism flexes the elastic latch members radially inward to disengage the recess and permit withdrawal of the lid from the container.

8 Claims, 3 Drawing Figures

LOCKING DEVICE FOR GARBAGE CAN LID

BACKGROUND OF THE INVENTION

This invention relates to locking devices for container lids, and more particularly to a locking device for latching a lid to a cylindrical container having an internal annular recess.

Locking devices for covers and container lids of various types are well known in the art, such as those disclosed in the following U.S. patents:

U.S. Pat. No. 965,590—Lokody—July 26, 1910
U.S. Pat. No. 1,015,907—Ryder—Jan. 30, 1912
U.S. Pat. No. 1,129,222—Nylund—Feb. 23, 1915
U.S. Pat. No. 1,160,010—Svenson—Nov. 9, 1915
U.S. Pat. No. 1,484,062—Conner—Feb. 19, 1924
U.S. Pat. No. 1,766,366—Welch et al—June 24, 1930
U.S. Pat. No. 2,632,580—Biddlecombe—Mar. 24, 1953
U.S. Pat. No. 2,717,167—Worth—Sept. 6, 1955
U.S. Pat. No. 2,735,571—Lockwood—Feb. 21, 1956
U.S. Pat. No. 2,735,752—Getz—Feb. 21, 1956
U.S. Pat. No. 2,768,851—Gifford—Oct. 30, 1956
U.S. Pat. No. 3,336,065—Roberson—Aug. 15, 1967
U.S. Pat. No. 4,384,656—McQuiston—May 24,1983
U.S. Pat. No. 4,390,110—Pirro—June 28, 1983

All of the above patents, except the Pirro U.S. Pat. No. 4,390,110 disclose a control device associated with the handle of the lid for operating the locking device.

Lokody, Welch and Worth disclose latch handles movable relative to the fixed lid handle. Each latch handle is connected to the upper end of a vertically reciprocable rod received through an opening in the top of the lid. The lower end of each rod is connected to radially disposed link or latch rods, the outer ends of which define radially movable latch members for securing the edge of the lid to the rim of the can. In each of these patents, a coil spring surrounds the vertically reciprocable rod to urge the handle down and the latch members outwardly into locking position.

The Svenson patent discloses a U-shaped latch handle 20 vertically movable relative to the fixed lid handle 14.

The Ryder patent discloses leaf spring members 11 connected to a vertically reciprocable handle member, and having its opposite ends adapted to extend beneath the inwardly extending flanges 14, in locking position.

FIG. 9 of McQuiston discloses a radially extending latch rod R, the extremity of which is adapted to fit beneath the bead C of the trash receptacle T.

Worth also discloses a pivotal catch 24 adapted to fit within a recess beneath the bead of the garbage can.

The Lokody and Worth patents disclose connecting rods which are pivotally connected to the vertically reciprocable operating rod and also pivotally connected to the latch members.

None of the above patents disclose a handle-actuated locking device for a container lid in which the latch members engaging the internal recess of the container wall are made of elastic material sufficient to flex in order to fit cans in which the cans or lids are slightly "out-of-round".

SUMMARY OF THE INVENTION

Accordingly, it is an object of this invention to provide a locking device for a container lid, and particularly a garbage can having a cylindrical wall with an internal annular bead or an internal annular recess, incorporating a handle actuator for positively locking and unlocking the lid to the container by engaging the internal annular bead or recess.

Another object of this invention is to provide a locking device for a container lid in which a positive lock for the lid in closed position can be obtained even when the lid or container wall is slightly "out-of-round".

A further object of this invention is to provide a handle-controlled lid locking device in which the latch members engaging the internal annular bead or recess of the can wall are elastic and adapted to effect a positive grip against the can wall.

Another object of this invention is to provide a garbage can lid lock in which the locking function is reinforced when an upward pull is exerted upon the locked lid, without lifting the latch handle.

DESCRIPTION OF THE PREFERRED EMBODIMENTS

Figure 1:
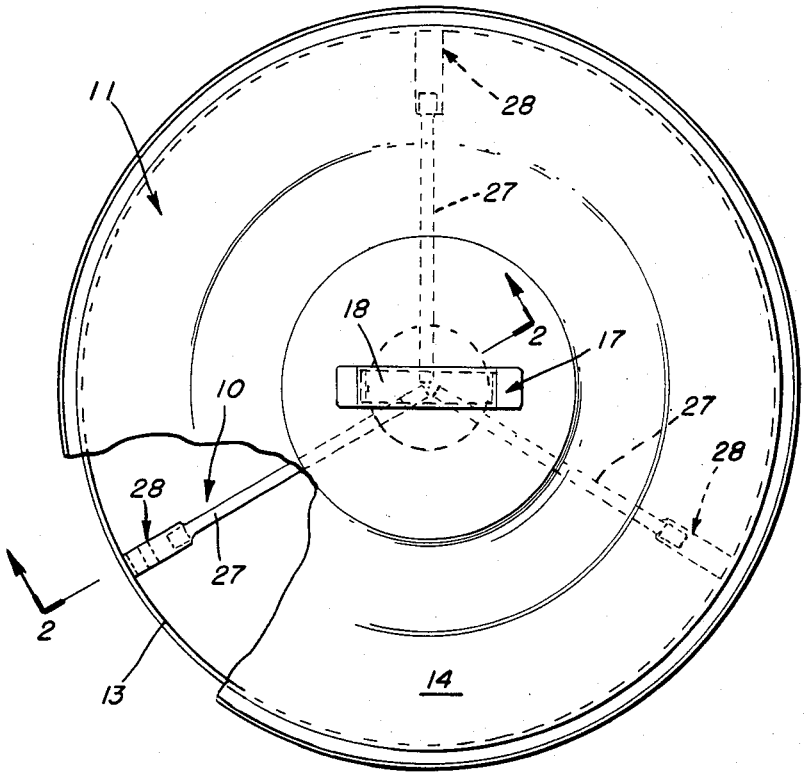
FIG. 1 is a top plan view of the locking device, made in accordance with this invention, in locking position in cooperation with a container lid and a container wall having an internal annular bead.
Figure 2:
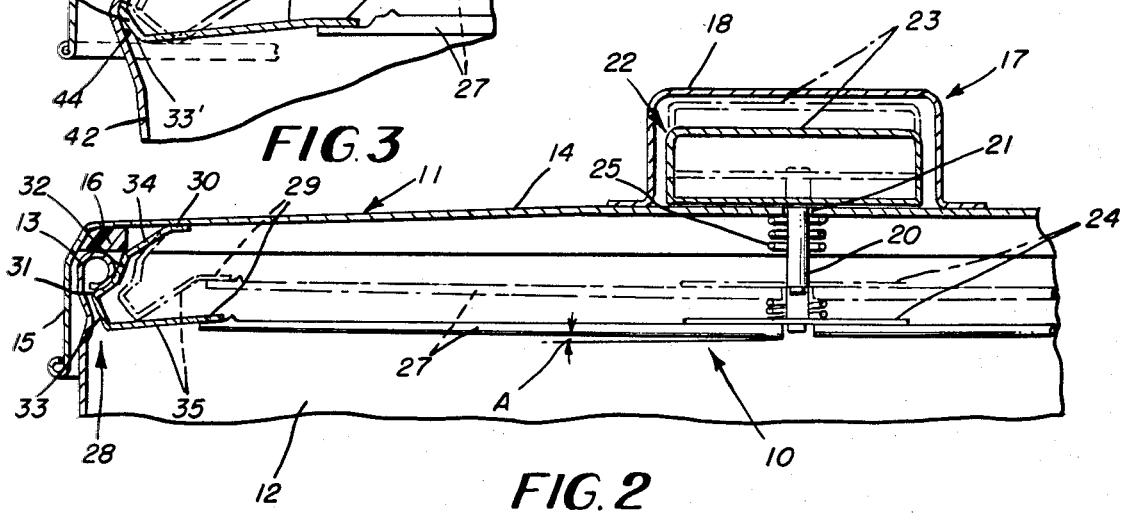
FIG. 2 is an enlarged, fragmentary section taken along the line 2—2 of FIG. 1, illustrating the unlocked position of the locking device in phantom.

Referring now to the drawings in more detail, FIGS. 1 and 2 disclose a locking device 10, made in accordance with this invention, mounted in a container lid 11 for cooperation with a substantially cylindrical container or container wall 12 having a radially inward projecting annular rim or bead 13 defining the perimeter of the open top of the can wall 12. The lid 11 includes a circular top wall 14 and a depending annular, substantially cylindrical, skirt wall 15 overlapping the upper portion of the cylindrical can wall 12.

The inside of the lid 11 may be provided with an annular sealing gasket 16, if desired, to seat against the upper surface of the annular bead 13 to seal the contents of the container 12.

Fixed to the center of the upper surface of the top lid wall 14, is an inverted U-shaped handle 17 including a transverse handle bar 18.

The locking device 10 includes a vertical operating rod 20 received through a hole 21 in the center of the top wall 14 of the lid 11 to permit free vertical reciprocable movement of the operating rod 20. Fixed to the upper end of the operating rod 20 is a stirrup-shaped, or loop-shaped, latch handle 22 having an upper transverse handle bar 23 spaced below the fixed handle bar 18 when the operating rod 20 is in its lower locking position, as disclosed in solid lines in FIG. 2.

Fixed to the bottom end of the operating rod 20 is a dish-shaped support plate 24, concave upward. Surrounding the operating rod 20 between the support plate 24 and the bottom surface of the top lid wall 14 is a coil spring 25 biasing the rod 20 downward toward its locking position.

Rigidly fixed to the support plate 24 are a plurality of (three disclosed in FIG. 1) substantially rigid, but slightly flexible, connecting rods 27 projecting radially outward toward the container wall, but not extending as far as the container wall. The dished shape of the support plate 24 causes the rods 27 to extend radially upward at a slight angle A to the horizontal, as disclosed in FIG. 2.

Fixed to the free end of each of the connecting rods 27 is a bow-shaped elastic latch member or clip 28. The lower end portion 29 of the latch member 28 is fixedly secured to the free end portion of the corresponding connecting rod 27, such as by welding. The upper end portion 30 of the latch member 28 is rigidly fixed, such as by welding to the under surface of the top wall 14 adjacent the perimeter of the lid 11, but radially spaced inward from the bead 13.

The bowed intermediate portion of the latch member 28 includes a recessed seat portion or area 32, which is concave to engage and fit against and beneath the arcuate surface of the bead 13 when the locking device 10 is in its locking position, as disclosed in solid lines in FIG. 2. Immediately below the seat portion 32 is a connecting portion 33 which declines radially inward from a projecting annular rib 31 which normally projects into a recess area below the bead 13 in the locking position. The upper edge of the seat portion 32 is connected to the upper end 30 by an elastic upper leg member 34, while the lower end of the connecting portion 33 is connected to the lower end 29 of the latch member 28 by a lower elastic leg member 35.

The entire latch member 28, including the opposite ends 29 and 30, the leg members 34 and 35, the seat portion 32 and the connecting portion 33, is preferably formed as an integral one-piece member, and of the same elastic material, such as spring steel. Because the leg members 34 and 35 are longer than the other elements in the latch member 28, the leg members 34 and 35 are more elastic and tend to flex more than the other parts of the latch member 28, when the locking device 10 is moved to its unlocking position as disclosed in phantom in FIG. 2.

In the operation of the invention, the lid 11 may be placed over the open top of the container 12 to close the same by the operator grasping the spaced handle bars 23 and 18 and pulling up the movable latch handle bar 23 until it has been raised sufficiently, such as to the phantom line position disclosed in FIG. 2, to raise the operating rod 20, the support plate 24, and the radial connecting rods 27 in a vertical translatory motion, to retract the latch members 28 from their latching engagement with the bead 13. As disclosed in FIG. 2, as the connecting rods 27 are raised, so are the fixed lower ends 29 of each of the latch members 28. This action causes the elastic leg members 34 and 35 to flex, not only toward each other, but downward about the respective fixed ends 30 and 29 as pivot points, to urge the seat area 32 radially inward away from engagement with the bead 13, as illustrated by the phantom position of FIG. 2.

After the locking device 10 is unlatched, the operator raises the adjacent handles 18 and 23 to elevate the lid 11 and open the top of the container 12. The latch handle 23 may then be released.

In order to replace the lid 11 over the open top of the container 12, the handles 18 and 23 are again squeezed to elevate the operating rod 20 and the connecting rods 27 to the phantom position disclosed in FIG. 2 to withdraw the latch members 28 radially inward to clear the bead 13 as the lid 11 is lowered to its closed position. After the lid 11 is in its closed position, the latch handle 23 is released to cause the coil spring 25 to force the support plate 24 and radial connecting rods 27 downward to urge the latch member 28 again to its solid-line latched position of FIG. 2, in which the seat area 32 is firmly seated against the corresponding surface of the bead 13 and the rib 31 projects beneath the bead 13.

Should any upward pull be exerted upon the lock lid 11, the combined upward movement of the lid 11, latch handle bar 23 and operating rod 20 will cause the support plate 24 to raise the inner ends of the connecting rods 27 relative to the latched extreme ends of the rods 27. Thus, the rods 27 will tend to flex toward a horizontal position, reducing the angle A, and in effect tending to expand the effective lengths of the radial rods 27, thereby forcing the latch clips 28 radially outward into a more binding engagement with the annular bead 13. Such upward pull might be caused by a person grasping only the handle 18, and not the latch handle bar 23, and pulling upward on the lid 11, or a dog attempting to lift the skirt wall 15 of the lid 11, to gain entry to the contents of the can 12. Moreover, such tendency of the connecting rods 27 to radially expand would permit the operator to grasp the handle 18 in order to lift the entire locked container 12 to transport the container 12 from one location to another.

Figure 3:
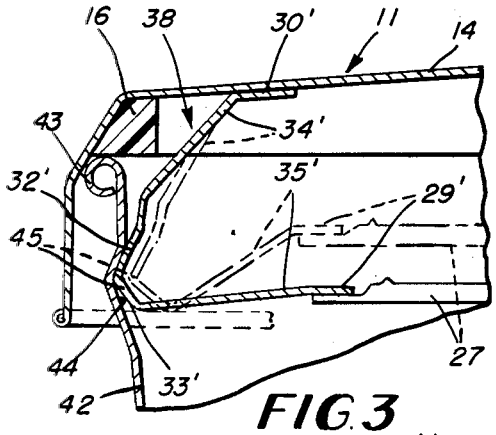
FIG. 3 is an enlarged fragmentary side elevational view of a modified locking device in its locking position in solid lines and its unlocked position in phantom, in cooperation with a container wall having an external annular bead and an internal annular recess.

A modified form of latch member or clip 38 for locking a lid 11 to a container or container wall 42 having an external bead 43 and an annular recess 44, is disclosed in FIG. 3.

The latch member 38 includes parts 29', 30', 32', 33', 34' and 35' substantially corresponding to the elements 29, 30 and 32–35 of the latch member 28, except having slightly different shapes and sizes. The seat area 32' merges with the connecting portion 33' to form a radially outward projecting rib 45 which is adapted to seat within the annular recess 44 in the solid-line locking position of FIG. 3. The lower end portion 29' of the latch member 38 is fixed, such as by welding, to the free radial end of each connecting rod 27 in the same manner as the connection of the lower end 29 of the latch member 28 to the connecting rod 27 of FIG. 2.

The radially extending connecting rods 27 in FIG. 3 are actuated by the same mechanism that they are in FIG. 2. Thus, when the connecting rod 27 in FIG. 3 is moved to its unlocked position, as illustrated in phantom in FIG. 3, the elastic legs 34' and 35' are flexed downward and toward each other in the same manner as the corresponding legs 34 and 35 of the latch member 28. Accordingly, the projection rib 45 is moved radially inward to disengage the annular recess 44 and to permit the lid 11 to be raised to open the container 42.

Otherwise, the elastic latch member 38 functions in substantially the same manner as the latch member 28, in order to accomodate a slightly different type of annular recess in the can wall 42 in contra-distinction to the recess formed below the internal bead 13 in the can 12 of FIG. 2.

It has been found that the locking device 10 made in accordance with this invention is particularly effective in closing and locking a lid 11 over the open top of a container 12 or 42 having a cylindrical wall, when any portion of the perimeter of the open top of the container wall is out-of-round to a slight degree. In such event, the independent elasticity of each circumferentially spaced latch member 28 or 38 permits a firm seating between the seat areas 32 or 32' or 45 and the corresponding out-of-round bead 13 or annular recess 44, so that each of the latch members 28 or 38 is in secure and positive latching engagement with the corresponding portion of the internal bead 13 or annular recess 44.

What is claimed is:

1. In a container having a substantially cylindrical wall and an open top, and an annular recess adjacent the open top and opening radially inward from the cylindrical wall, and a lid covering the open top having a top wall, a locking device, comprising:

(a) a handle member having a transverse handle bar fixed to the top wall, (b) a vertical operating rod having an upper end portion and a lower end portion, (c) an opening in the top wall beneath said handle bar for receiving said operating rod for vertical reciprocable movement, (d) a latch handle fixed to said upper end portion of said operating rod and spaced below said handle bar when said operating rod is in a lower locking position, (e) at least one connecting rod rigidly connected to said lower end portion of said operating rod and projecting radially outward toward the container wall, (f) a latch member having upper and lower ends and a bowed elastic intermediate portion, (g) said upper end being fixed to the top wall of the lid and spaced inwardly from the container wall, and said lower end being fixed to said connecting rod, so that said bowed intermediate portion projects radially outward in latching engagement with the annular recess of the container wall when said operating rod is in said locking position, said bowed intermediate portion being flexed to a retracted position disengaging the annular recess when said operating rod is in an upper unlocking position.

2. The invention according to claim 1 further comprising spring means biasing said operating rod towards its lower locking position.

3. The invention according to claim 1 in which said bowed intermediate portion comprises a radially outward projecting annular rib adapted to be received in the annular recess in the container wall in said locking position.

4. The invention according to claim 3 in which said connecting rod and said lower end of said latch member fixed to said connecting rod move upward in a substantially translatory motion as said operating rod moves from its locking position to its unlocking position, whereby said bowed intermediate portion flexes to said retracted position.

5. The invention according to claim 4 in which said annular rib is connected to said upper and lower ends by upper and lower elastic leg members which flex downward and toward each other as said operating rod moves from its lower locking position to its upper unlocking position.

6. The invention according to claim 5 in which the annular recess is an annular space beneath a radially inward projecting bead on the container wall, and said bowed elastic intermediate portion comprises a seat portion concave arcuate to receive the bead of the container wall.

7. The invention according to claim 1 further comprising a plurality of said connecting rods circumferentially spaced about said operating rod and a corresponding number of said latch members, each of said latch members being fixed to the radial extremity of a corresponding connecting rod for independent locking engagement with the annular recess in circumferentially spaced positions.

8. The invention according to claim 7 in which said connecting rods are mounted on said operating rod to project radially outward and upward at a slight angle to the horizontal in said locking position, said connecting rods being adapted to flex when said operating rod is pulled upwardly in said locking position to cause the radial ends of said connecting rods to exert additional pressure against said latch members seated in the annular recess.

* * * * *